United States Patent [19]

Craig et al.

[11] 4,414,816

[45] Nov. 15, 1983

[54] COMBUSTOR LINER CONSTRUCTION

[75] Inventors: Harold M. Craig, West Hartford; Walter B. Wagner, Bolton; William J. Strock, Vernon, all of Conn.

[73] Assignee: The United States of America as represented by the Administrator of the National Aeronautics and Space Administration, Washington, D.C.

[21] Appl. No.: 136,652

[22] Filed: Apr. 2, 1980

[51] Int. Cl.[3] ..... F23R 3/60

[52] U.S. Cl. ..... 60/757

[58] Field of Search ..... 60/752, 753, 755, 757

[56] References Cited

U.S. PATENT DOCUMENTS

| | | | |
|---|---|---|---|
| 2,684,572 | 7/1954 | Marskell et al. | 60/757 |
| 2,919,549 | 1/1960 | Haworth et al. | 60/753 |
| 3,016,703 | 1/1962 | Lorett et al. | 60/752 |
| 3,422,620 | 1/1969 | Fantozzi et al. | 60/755 |
| 4,132,066 | 1/1979 | Austin et al. | 60/752 |
| 4,253,301 | 3/1981 | Vogt | 60/757 |

FOREIGN PATENT DOCUMENTS

| | | | |
|---|---|---|---|
| 1089467 | 11/1967 | United Kingdom | 60/757 |

*Primary Examiner*—Robert E. Garrett

*Attorney, Agent, or Firm*—Norman T. Musial; John R. Manning

[57] ABSTRACT

A combustor liner is fabricated from a plurality of individual segments each containing counter/parallel Finwall material and are arranged circumferentially and axially to define the combustion zone. Each segment is supported by a hook and ring construction to an opened lattice frame with sufficient tolerance between the hook and ring to permit thermal expansion with a minimal of induced stresses.

4 Claims, 2 Drawing Figures

COMBUSTOR LINER CONSTRUCTION

CROSS REFERENCE

This invention is related to the inventions disclosed in copending patent applications entitled COMBUSTOR LINER CONSTRUCTION FOR GAS TURBINE ENGINE, U.S. Ser. No. 136,631, filed Apr. 2, 1980 by Thomas L. DuBell and COMBUSTOR LINER CONSTRUCTION, U.S. Ser. No. 136,848, filed Apr. 2, 1980 by I. S. Tanrikut, W. B. Wagner, I. Segalman and P. Goldberg and both assigned to the same assignee of this application.

DESCRIPTION

1. Technical Field

This invention relates to combustor liners for gas turbine engines and more particularly to fabricating the liner by individual panels having counter/parallel cooling flow passages and the panels are arranged in segmented fashion in both the circumferential and axial directions.

2. Background Art

This invention constitutes an improvement over the liner configuration described and claimed in U.S. Pat. No. 3,706,203 granted to P. Goldberg and I. Segalman on Dec. 19, 1972 which is assigned to the same assignee at this patent application and which is incorporated herein by reference. The above-mentioned patent discloses a sandwiched constructed liner that has spaced walls configured in a continuous hoop to define the combustion chamber. The walls are louvered and at each stepped section the upstream end is exposed to the cavity of cooling air from the compressor that surrounds the liner. This leads cooling air through longitudinal passageways formed between the spaced walls into the combustion chamber for maintaining the liner at a tolerable temperature.

The referenced patent application of P. Goldberg, I. Segalman, W. B. Wagner and I. Tanrikut discloses the construction of a combustor liner with Finwall ® material that has been fabricated to achieve a counter/parallel flow relationship for improved convective and film cooling. This combustor liner as well as the heretofore known types are fabricated into continuous or full hoops, with the attendant high hoop stresses occasioned by the extreme radial temperature gradients manifested by the hostile environment of a combustor.

The patent application filed by T. L. DuBell utilizes a Finwall material as the liner but mechanically attaches sections of the Finwall material to the cooler wall. The cooler wall, like the heretofore known combustors is a continuous hoop.

We have found that we can achieve an improved combustor liner by fabricating the liner from individual sections segmented in a circumferential and axial direction and supported to an open lattice frame that is disposed in the cool air cavity surrounding the combustor liner. Each segment, consisting of several panels which may be formed with a double wall construction having longitudinal passages and counter/parallel cooling flow, carries on the ends of the cooler wall a hook that engages a ring element formed in the lattice of the frame. The hook and ring elements are dimensioned with sufficient clearance to allow limited unconstrained motion of the segment relative to the frame to prevent stresses induced by binding thereof.

It is contemplated that feather seals be utilized so as to minimize leakage between adjacent segments.

As will be appreciated by one skilled in the art, this segmented construction lends itself to producing each segment as a casting rather than utilizing sheet metal stock. This permits use of materials having improved characteristics over the heretofore utilized sheet metal materials. For example, each segment could be cast from the same material utilized for fabricating turbine blades.

DISCLOSURE OF THE INVENTION

An object of this invention is to provide for a gas turbine engine an improved combustor liner.

A feature of the invention is to fabricate the combustor liner with individual segments arranged axially and circumferentially to form the complete liner. A frame carrying circumferential rings supports each segment having engaging hooks mounted on the cooler wall of the segment. The tolerances between the hooks and rings are such that unconstrained movement is permitted, thereby minimizing undue thermal stresses in the segments.

This invention permits the panels to be cast maximizing the types of materials that can be employed.

Other features and advantages will be apparent from the specification and claims and from the accompanying drawings which illustrate an embodiment of the invention.

BEST MODE FOR CARRYING OUT THE INVENTION

As will be appreciated by one skilled in this art, while the invention is shown it its preferred embodiment as an annular combustor, a burner can or the combination thereof is contemplated within the scope of this invention.

Figure 1:
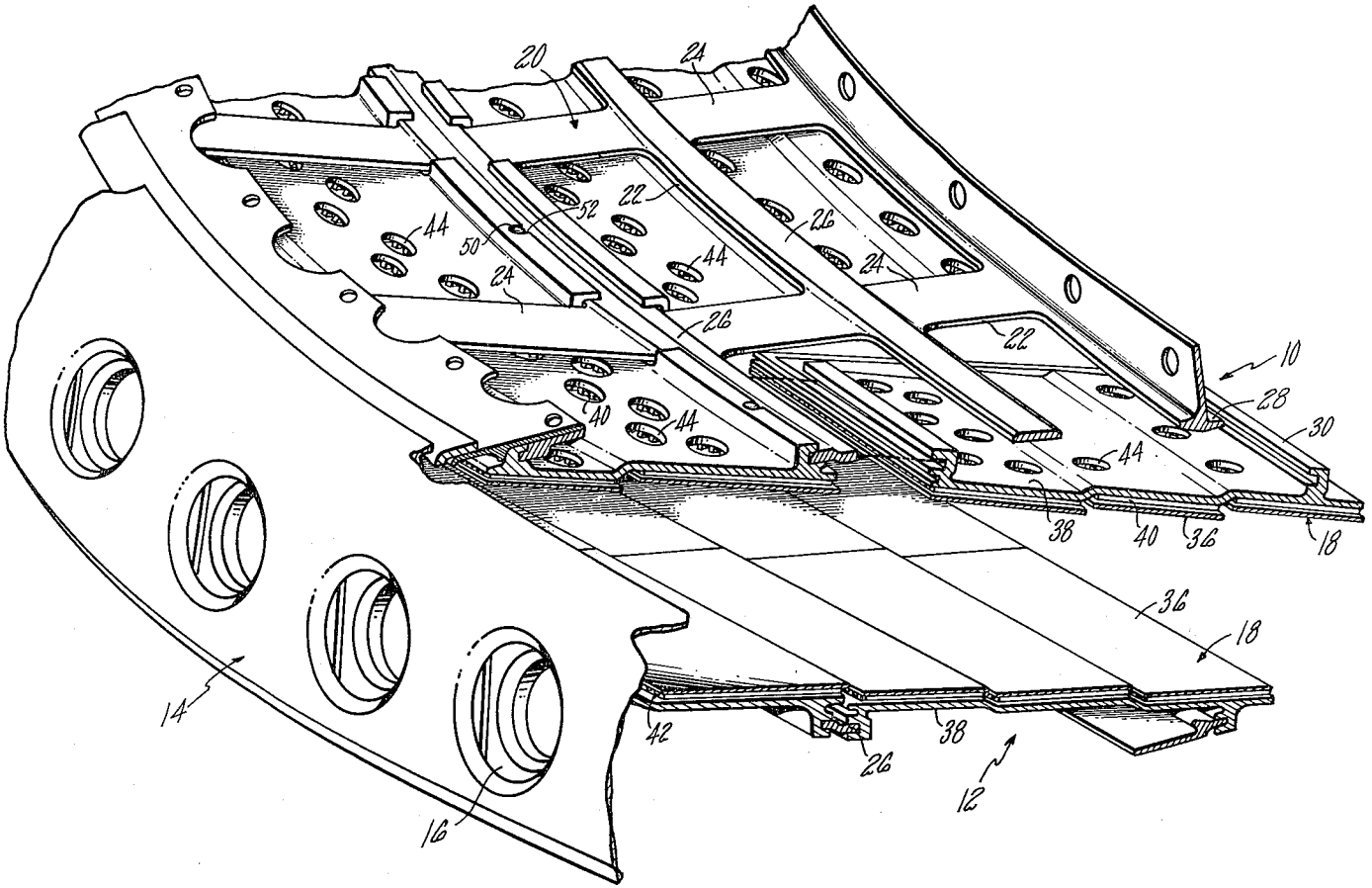
FIG. 1 is a partial view in perspective and partly exploded to show the segment configuration for an annular combustor.
Figure 2:
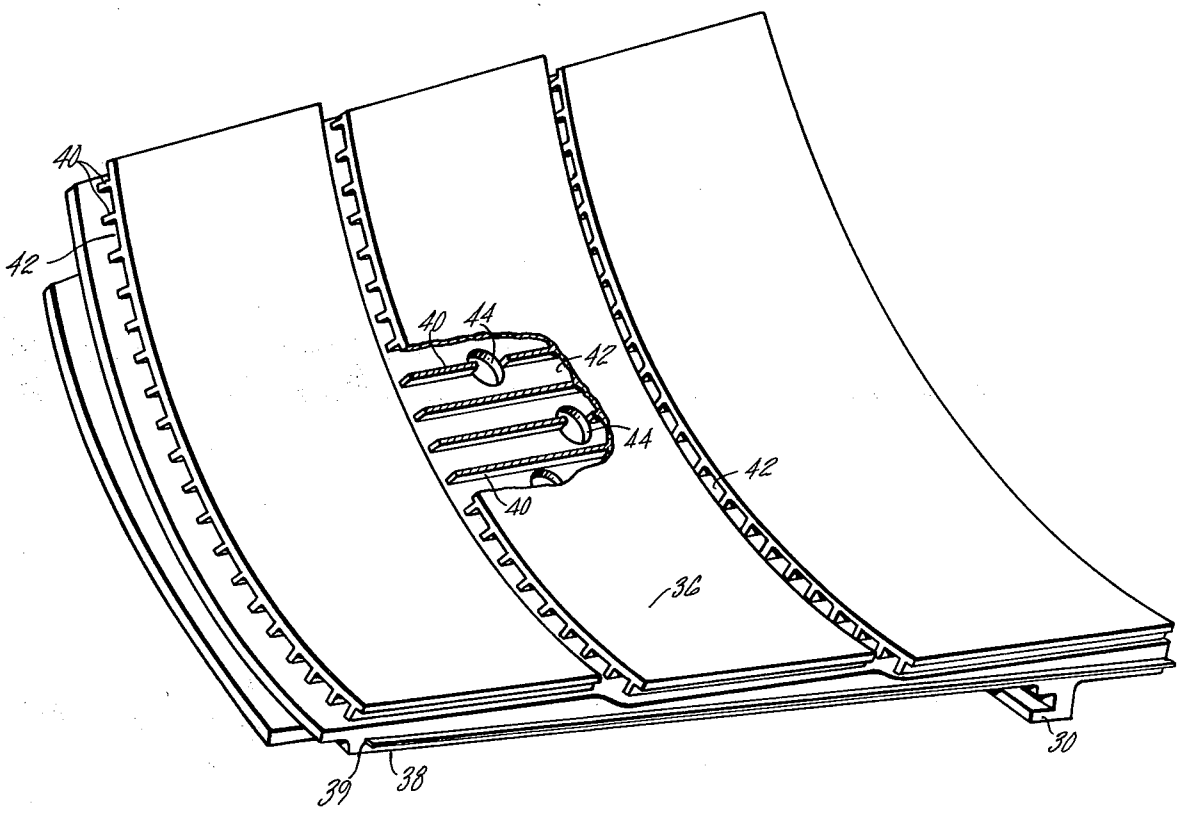
FIG. 2 is a perspective view showing the details of a segment.

FIGS. 1 and 2 show the inner liner segment 10 and the outer liner segment 12 concentrically spaced about the axial axis defining the inner and outer walls of the annular combustor. Bulkhead 14 joins the two at one end sealing one end and supporting a plurality of fuel nozzles (not shown) intended to fit into the circumferentially spaced apertures 16. As best seen in FIG. 1, the inner and outer liner is fabricated from a pluarlity of generally curvatured retangularly shaped segments 18 that are interlocked to the support frame 20. The support frame is an open lattice piece that carries a plurality of windows 22 over which the segments lie. The frame basically consists of axially running ribs 24 relative to the direction of the engine axis and circumferential rings 26. The rings have a lip 28 to which a hook 30 formed on the segment engages. Hence each segment fits into the tongue and groove arrangement and combined to form the basic cylindrically shaped liner structure.

It is apparent from the foregoing that segments are mounted in the circumferential and axial direction defining the combustion chamber. Hence, this structure forms segments in the hoop as well as segments in the axial direction. The hoop stresses having been a concern in the past, are held to a minimum by permitting the segments to thermally expand with minimal constraints. Each hook and ring have sufficient clearance to allow for thermal expansion and avoiding their binding up and causing undue stresses.

To prevent undue leakage around each segment, feather seals are fitted into grooves 39 along the side of each segment. As noted, the frame is mounted on the outside wall of the liner segments which is exposed to the cooler air supplied by the engine's compressor (not shown). Obviously, combustion is confined between the inner and outer liner segments.

As noted in FIG. 2, each segment is constructed from an inner and outer wall 36 and 38, respectively; the inner or hot wall 36 being closer to combustion and the outer cool wall 38 being closer to the cooling air. Sandwiched between and attached to both inner and outer walls 36 and 38, is a plurality of depending walls 40 which run axially for defining longitudinal passageways 42. Cool air from the adjacent cavity is fed into each of the longitudinal passageways from inlet openings 44 disposed circumferentially around the circumference of the cool wall 38 and intermediate the ends of the longitudinal passageways 42. This directs a portion of the cooling air in a counter direction and the remaining portion parallel to the flow of combustion products in the combustor.

This utilization of individual segments to build up the liner affords the advantage of having each segment cast from exotic materials of the type utilized for fabricating turbine blades. Hence, each panel could be cast from well known turbine material which has improved hot strength and thermal mechanical fatigue resistance over the sheet metal heretofore used. This also affords the advantage of casting the cooling passages into the panel to allow complex cooling techniques to reduce temperature gradients and possibly reduce required cooling flow levels. Liner growth and distortions are less likely to alter cooling air passageway configurations resulting in uniform cooling throughout the life of the liner. Amongst the techniques for casting the panels that are available are Equi-ax, directionally solidified or single crystal. For further details of exemplary casting techniques, reference is made to U.S. Pat. Nos. 3,260,505 and 3,494,709.

Pins 50 projecting through the frame element at discrete locations align with a slot 52 in the panel and may be used to index and guide the segments into place upon assembly.

While the individual panels on the segments were constructed in the form of counter/parallel cooling flow walls, it is contemplated within the scope of this invention that the panels could employ other cooling techniques. What is deemed important in this invention is that it solves the problem of high hoop stresses in a continuous hoop liner that is subjected to extreme radial temperature gradients across the liner walls As shown by this invention, hoop stresses are virtually eliminated or minimized by stacking segments circumferentially and axially to form the liner contour.

It should be understood that the invention is not limited to the particular embodiments shown and described herein, but that various changes and modifications may be made without departing from the spirit and scope of this novel concept as defined by the following claims.

We claim:

1. A combustor liner for a gas turbine engine disposed in a cavity supplied with cooling air, said liner having a lattice type frame in said cavity, a plurality of rectangularly shaped segments supported to said frame and stacked in a circumferential and axial direction and being contoured to define the combustion chamber and being between the combustion products and said frame, means for cooling said segments, means for permitting thermal expansion of said segments in a relatively unconstrained movement whereby the hoop stresses are substantially eliminated, means for securing said segments to said frame for defining a generally annularly shaped combustion zone.

2. A combustor liner as in claim 1 wherein said cooling means includes axially spaced panels each having an outer wall circumscribing said circumferential portion of said segment, means interconnecting said segment and said outer wall defining elongated open ended passages, and means for admitting cooling air from the surroundig cavity into said passages at a point intermediate the ends thereof for directing a portion of the cooling air counter and a portion parallel to the products of combustion in said combustion chamber.

3. A combustor liner as in claim 2 wherein said securing means includes hook means on the end of said segment for engaging a circumferential ring defined by said frame for supporting said segment to said frame.

4. A combustor liner as in claim 3 including feather seals adjacent each of said segments.

* * * * *